US010417957B2

(12) United States Patent
Liu

(10) Patent No.: US 10,417,957 B2
(45) Date of Patent: Sep. 17, 2019

(54) DISPLAY AND METHOD OF PROLONGING LIFETIME OF DISPLAY

(71) Applicant: Wuhan China Star Optoelectronics Technology Co., Ltd., Wuhan, Hubei (CN)

(72) Inventor: Minlun Liu, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 169 days.

(21) Appl. No.: 15/533,919

(22) PCT Filed: Apr. 11, 2017

(86) PCT No.: PCT/CN2017/080024

§ 371 (c)(1),
(2) Date: Jun. 7, 2017

(87) PCT Pub. No.: WO2018/166021

PCT Pub. Date: Sep. 20, 2018

(65) Prior Publication Data

US 2018/0330660 A1 Nov. 15, 2018

(30) Foreign Application Priority Data

Mar. 13, 2017 (CN) ..... 2017 1 0144574

(51) Int. Cl.
*G09G 5/02* (2006.01)
*G09G 3/3208* (2016.01)
(Continued)

(52) U.S. Cl.
CPC ..... *G09G 3/3208* (2013.01); *G09G 5/391* (2013.01); *G09G 3/3266* (2013.01);
(Continued)

(58) Field of Classification Search
CPC .... G09G 3/3208; G09G 5/391; G09G 3/3275; G09G 2340/0407; G09G 3/3266; G09G 2320/048
See application file for complete search history.

(56) References Cited

U.S. PATENT DOCUMENTS 7,397,448 B2 * 7/2008 Stevenson ..... G09G 3/3233 315/169.3
8,665,201 B2 * 3/2014 Ueno ..... G09G 3/006 345/100
(Continued)

FOREIGN PATENT DOCUMENTS

CN 1641727 A 7/2005
CN 101373575 A 2/2009
(Continued)

*Primary Examiner* — Vijay Shankar
(74) *Attorney, Agent, or Firm* — Andrew C. Cheng

(57) ABSTRACT

A method of prolonging a lifetime of a display includes monitoring a display time period of a displaying image; determine whether the display time period of the display image is not less than a predetermined time period; and lowering a resolution of the displaying image if the display time period of the display image is not less than the predetermined time period. A display is also provided. By using the display and the method of prolonging lifetime of the display according to the present embodiment, the requirement energy of displaying image is greatly reduced, thereby saving cost. In addition, all of the pixels are alternately applied to data voltage to display during displaying frames. Accordingly, a lifetime of each of pixels and the display are prolonged.

8 Claims, 3 Drawing Sheets

(51) Int. Cl.

| | |
|---|---|
| ***G09G 5/391*** | (2006.01) |
| *G09G 3/3275* | (2016.01) |
| *G09G 3/3266* | (2016.01) |

(52) U.S. Cl.

CPC ... *G09G 3/3275* (2013.01); *G09G 2310/0213* (2013.01); *G09G 2310/0224* (2013.01); *G09G 2320/043* (2013.01); *G09G 2320/048* (2013.01); *G09G 2330/021* (2013.01); *G09G 2330/023* (2013.01); *G09G 2340/0407* (2013.01); *G09G 2340/0435* (2013.01)

(56) References Cited

U.S. PATENT DOCUMENTS

| | | | | |
|---|---|---|---|---|
| 9,343,006 | B2 * | 5/2016 | Li | G09G 3/2022 |
| 9,990,882 | B2 * | 6/2018 | Chaji | G09G 3/3233 |
| 10,043,448 | B2 * | 8/2018 | Li | G09G 3/2022 |
| 2004/0207653 | A1 | 10/2004 | Starvely | |
| 2006/0012587 | A1 * | 1/2006 | Stevenson | G09G 3/3233 345/204 |
| 2011/0069058 | A1 | 3/2011 | Chung | |

FOREIGN PATENT DOCUMENTS

| | | | |
|---|---|---|---|
| CN | 101615374 | A | 12/2009 |
| CN | 101650912 | A | 2/2010 |
| CN | 103901688 | A | 7/2014 |
| CN | 104978944 | A | 10/2015 |
| CN | 105070220 | A | 11/2015 |
| CN | 105825801 | A | 8/2016 |
| WO | WO2016009909 | A1 | 1/2016 |

* cited by examiner

DISPLAY AND METHOD OF PROLONGING LIFETIME OF DISPLAY

BACKGROUND

1. Field of the Disclosure

The present disclosure relates to a display field, and more particularly, to a display and a method of prolonging lifetime of a display.

2. Description of the Related Art

An organic electroluminescence display is a competitive display in the future. When displaying a black image, the organic electroluminescence display with high contrast can display a pure black image. In addition, in contrast to a liquid crystal display, the organic electroluminescence display has advantages over higher color gamut, better saturation, better flicker and flexibility.

However, during lighting states, the organic electroluminescence display causes higher power consumption than the liquid crystal display on the same brightness. A lifetime of the organic electroluminescence display shortens as the light time extends during lighting states. In the case of showing an image for a long while, e.g. reading documents on an e-book, painting or taking notes on a mobile phone screen, the display panel easily displays residual image and gets hot.

SUMMARY

The present disclosure proposes a display and a method of prolonging lifetime of a display in order to solve the problems of the related art.

According to the present disclosure, a method of prolonging a lifetime of a display includes: monitoring a display time period of a displaying image; determine whether the display time period of the display image is not less than a predetermined time period; and lowering a resolution of the displaying image if the display time period of the display image is not less than the predetermined time period.

In one aspect of the present disclosure, a step of lowering a resolution of the displaying image comprises: lowering the resolution of the displaying image to one fourth of an original resolution of the displaying image.

In another aspect of the present disclosure, the display comprises M×N pixels arranged in an array, and a step of lowering a resolution of the displaying image comprises: doubling a frame rate of the display image; supplying gate signal to pixels at odd-numbered rows and supplying data signal to pixels at odd-numbered columns in a duration of displaying a frame A; supplying gate signal to the pixels at odd-numbered rows and supplying data signal to pixels at even-numbered columns in a duration of displaying a frame A+1; supplying gate signal to pixels at even-numbered rows and supplying data signal to the pixels at odd-numbered columns in a duration of displaying a frame A+2; and supplying gate signal to the pixels at the even-numbered rows and supplying data signal to pixels at the even-numbered columns in a duration of displaying a frame A+3.

In still another aspect of the present disclosure, the display comprises M gate lines and N data lines; a gate line at ith row is connected to all of pixels at the ith row, while a data line at jth column is connected to all of the pixels at the jth column, where $1 \leq i \leq M$ and $1 \leq j \leq N$. The step of lowering a resolution of the displaying image comprises: supplying the gate signal to the pixels at the odd-numbered rows through the odd-numbered gate lines and supplying the data signal to the pixels at the odd-numbered columns through the odd-numbered data lines in the duration of displaying a frame A; supplying the gate signal to the pixels at the odd-numbered rows through the odd-numbered gate lines and supplying the data signal to the pixels at the even-numbered columns through the even-numbered data lines in the duration of displaying a frame A+1; supplying the gate signal to the pixels at the even-numbered rows through the even-numbered gate lines and supplying the data signal to the pixels at the odd-numbered columns through the odd-numbered data lines in the duration of displaying a frame A+2; and supplying the gate signal to the pixels at the even-numbered rows through the even-numbered gate lines and supplying the data signal to the pixels at the even-numbered columns through the even-numbered data lines in the duration of displaying a frame A+3.

In yet another aspect of the present disclosure, the display is an organic electroluminescence display.

According to the present disclosure, a display includes: a monitor configured to monitor a display time period of a displaying image, a determining controller configured to determine whether the display time period of the display image is not less than a predetermined time period, and a adjusting controller configured to lower a resolution of the displaying image upon a condition that the display time period of the display image is not less than a predetermined time period.

In one aspect of the present disclosure, the adjusting controller is configured to lower the resolution of the displaying image to one fourth of an original resolution of the displaying image.

In another aspect of the present disclosure, the display comprises M×N pixels arranged in an array, the adjusting controller comprises a frequency raising unit configured to double a frame rate of the displaying image, a scan driving unit configured to supply gate signal to the pixels, and a data driving unit configured to supply data signal. The scan driving unit supplies gate signal to pixels at odd-numbered rows and the data driving unit supplies data signal to pixels at odd-numbered columns in a duration of displaying a frame A. The scan driving unit supplies gate signal to the pixels at odd-numbered rows and the data driving unit supplies data signal to pixels at even-numbered columns in a duration of displaying a frame A+1. The scan driving unit supplies gate signal to pixels at even-numbered rows and the data driving unit supplies data signal to the pixels at odd-numbered columns in a duration of displaying a frame A+2. The scan driving unit supplies gate signal to the pixels at the even-numbered rows and the data driving unit supplies data signal to pixels at the even-numbered columns in a duration of displaying a frame A+3.

In still another aspect of the present disclosure, the display further comprises M×N pixels arranged in an array. A gate line at ith row is connected to all of pixels at the ith row, while a data line at jth column is connected to all of the pixels at the jth column, where $1 \leq i \leq M$ and $1 \leq j \leq N$. The scan driving unit supplies the gate signal to the pixels at the odd-numbered rows through the odd-numbered gate lines and the data driving unit supplies the data signal to the pixels at the odd-numbered columns through the odd-numbered data lines in the duration of displaying a frame A. The scan driving unit supplies the gate signal to the pixels at the odd-numbered rows through the odd-numbered gate lines and the data driving unit supplies the data signal to the pixels at the even-numbered columns through the even-numbered data lines in the duration of displaying a frame A+1. The scan driving unit supplies the gate signal to the pixels at the even-numbered rows through the even-numbered gate lines and the data driving unit supplies the data signal to the pixels at the odd-numbered columns through the odd-numbered data lines in the duration of displaying a frame A+2. The scan driving unit supplies the gate signal to the pixels at the even-numbered rows through the even-numbered gate lines and the data driving unit supplies the data signal to the pixels at the even-numbered columns through the even-numbered data lines in the duration of displaying a frame A+3.

In yet another aspect of the present disclosure, the display is an organic electroluminescence display.

By using the display and the method of prolonging lifetime of the display according to the present embodiment, the requirement energy of displaying image is greatly reduced, thereby saving cost. In addition, all of the pixels are alternately applied to data voltage to display during displaying frames. Accordingly, a lifetime of each of pixels and the display are prolonged.

BRIEF DESCRIPTION OF THE DRAWINGS

The drawings illustrate embodiments of the invention and, together with the description, serve to explain the principles of the disclosure.

DETAILED DESCRIPTION OF THE PREFERRED EMBODIMENTS

Figure 1:
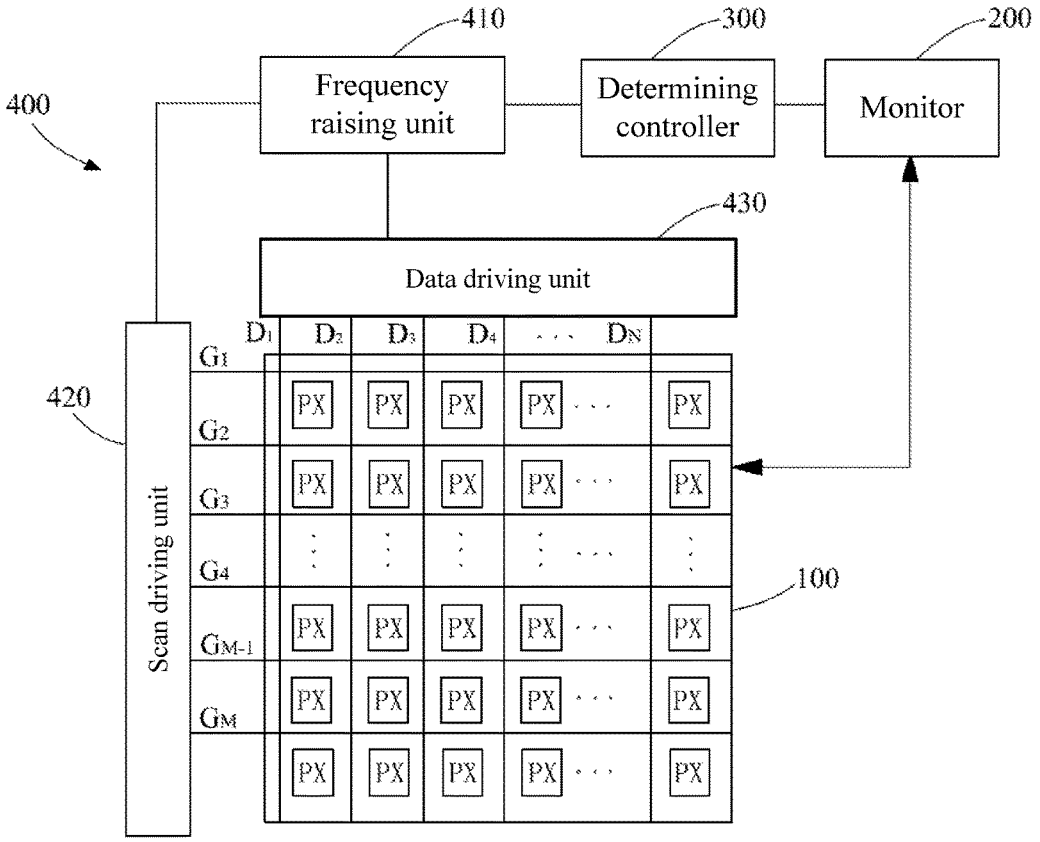
FIG. 1 illustrates a block diagram of a display according to an embodiment of the present disclosure.

The invention is described below in detail with reference to the accompanying drawings, wherein like reference numerals are used to identify like elements illustrated in one or more of the figures thereof, and in which exemplary embodiments of the invention are shown. This invention may, however, be embodied in many different forms and should not be construed as limited to the particular embodiments set forth herein. Rather, these embodiments are provided so that this disclosure will be thorough and complete, and will fully convey the scope of the invention to those skilled in the art.

In figures, in order to clarify the elements, the thickness of areas and layers are larger than the actual size. In addition, the same numbers in the figures are used to represent the same elements.

FIG. 1 illustrates a block diagram of a display according to an embodiment of the present disclosure. Preferably, the display is an organic electroluminescence display. In another embodiment, the display can be a liquid crystal display.

As shown in FIG. 1, the display of the present disclosure includes a display panel 100, a monitor 200, a determining controller 300, and an adjusting controller 400.

The display panel 100 includes a plurality of pixels PX arranged in an M×N array, M gate lines $G_1$-$G_M$, and N data lines $D_1$-$D_N$. The gate line $G_i$ at ith row is connected to all of the pixels PX at the ith row, while the data line $D_j$ at jth column is connected to all of the pixels PX at the jth column, where $1 \leq i \leq M$ and $1 \leq j \leq N$.

When the display panel 100 displays, the monitor 200 is configured to monitor a display time period of a displaying image. The determining controller 300 is configured to determine whether the display time period of the display image is not less than a predetermined time period. The adjusting controller 400 is configured to lower a resolution of the displaying image upon a condition that the display time period of the display image is not less than a predetermined time period.

For example, the display panel 100 includes 1440×2560 pixels, that is a normal resolution of the display panel 100 is 1440×2560. When the display panel 100 displays, the monitor 200 is configured to monitor a display time period of a displaying image. The determining controller 300 is configured to determine whether the display time period of the display image is not less than a predetermined time period. The adjusting controller 400 is configured to lower a resolution of the displaying image upon a condition that the display time period of the display image is not less than a predetermined time period.

In the embodiment of the present disclosure, in order to shorten operation time of each element causing low cost and high operation speed of the elements, preferably, the adjust controller 400 downgrades the resolution of the displaying image to one fourth of original resolution, i.e. a resolution of 720×1280. It is therefore understood that the downgraded ratio disclosed above is an example, rather than a limitation. The downgraded ratio can be selected based on practical requirement.

A reduction of resolution of the displaying image lowers power consumption of the displaying image, thereby saving energy. In addition, since a reduction of power consumption of the displaying image caused by the reduction of resolution of the displaying image lowers driven power of the display lower, a lifetime of the display prolongs.

Figure 2:
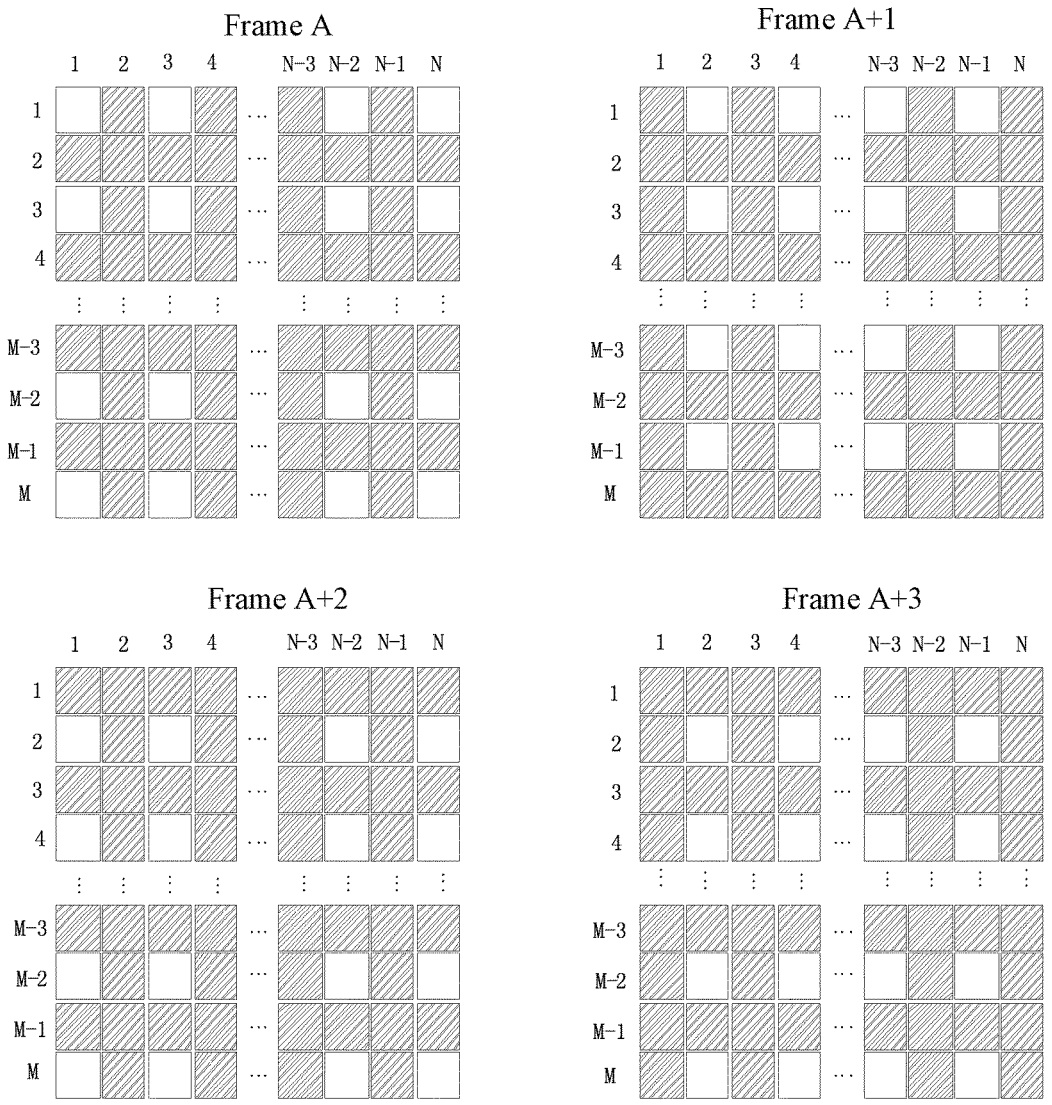
FIG. 2 illustrates driven pixels and non-driven pixels according to an embodiment of the present disclosure.

As introduced herein, the resolution of the display is downgraded to one fourth of the original resolution as an example. FIG. 2 illustrates driven pixels and non-driven pixels according to an embodiment of the present disclosure. In FIG. 2, slash-lined blocks represents pixels PX applied with data voltage, blank block represents pixels PX not applied with data voltage.

Referring to FIGS. 1 and 2, the adjusting controller 400 includes a frequency raising unit 410, a scan driving unit 420, and a data driving unit 430.

When the determining controller 300 determines that the display time period of the display image is not less than a predetermined time period, the frequency raising unit 410 doubles a frame rate of the displaying image. For example, the frame rate of the displaying image doubles from 60 Hz to 120 Hz. It is understood that a raised multiple of the frame rate is associated with a lowered proportion of the resolution.

When the frame rate doubles, as illustrated in FIG. 2, the scan driving unit 420 supplies gate signal to pixels PX at odd-numbered rows through odd-numbered gate lines and the data driving unit 430 supplies data signal to pixels PX at odd-numbered columns through odd-numbered data lines in a duration of displaying a frame A.

The scan driving unit 420 supplies gate signal to pixels PX at odd-numbered rows through odd-numbered gate lines and the data driving unit 430 supplies data signal to pixels PX at even-numbered columns through even-numbered data lines in a duration of displaying a frame A+1.

The scan driving unit 420 supplies gate signal to pixels PX at even-numbered rows through even-numbered gate lines and the data driving unit 430 supplies data signal to pixels PX at odd-numbered columns through odd-numbered data lines in a duration of displaying a frame A+2.

The scan driving unit 420 supplies gate signal to pixels PX at even-numbered rows through even-numbered gate lines and the data driving unit 430 supplies data signal to pixels PX at even-numbered columns through even-numbered data lines in a duration of displaying a frame A+3.

In the present embodiment, the frame rate and power consumption of the displaying image are doubled but the resolution of displaying image lowers to one fourth of the original resolution, the whole power consumption of the displaying image is half of original displaying image. Therefore, the present embodiment can reduce cost greatly.

Additionally, in the present embodiment, all of the pixels PX are alternately applied to data voltage to display during displaying frames. Accordingly, a lifetime of each of pixels PX are prolonged as well as the display.

Furthermore, when the determining controller 300 determines that the display time period of the display image is less than the predetermined time period, the frequency raising unit 410 disables. The scan driving unit 420 supplies gate signal to all of the pixels PX through gate lines and the data driving unit 430 supplies data signal to all of the pixels PX through data lines.

Figure 3:
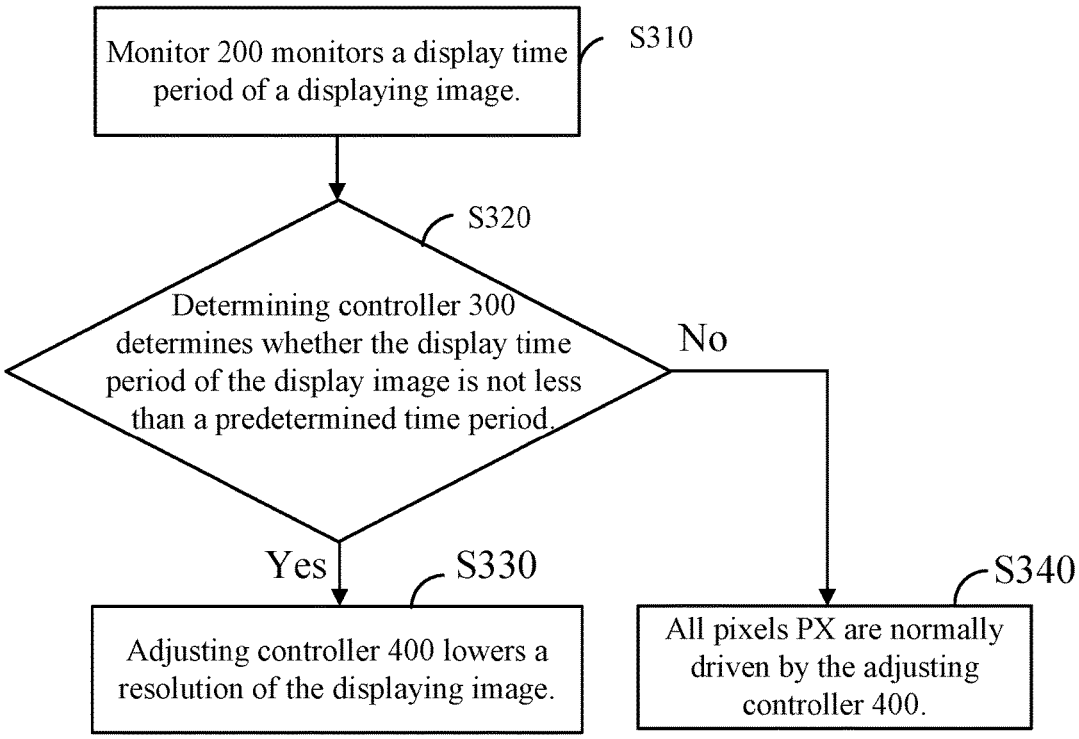
FIG. 3 illustrates a flowchart of a method of prolonging a lifetime of a display according to an embodiment of the present disclosure.

FIG. 3 illustrates a flowchart of a method of prolonging a lifetime of a display according to an embodiment of the present disclosure.

Referring to FIGS. 1 through 3, the method of prolonging a lifetime of a display according to an embodiment includes steps:

S310: The monitor 200 is used to monitor a display time period of a displaying image.

S320: The determining controller 300 is used to determine whether the display time period of the display image is not less than a predetermined time period. If it is, perform step S330, if not, perform step S340.

S330: The adjusting controller 400 is used to lower a resolution of the displaying image.

S340: The resolution of the displaying image remains and all pixels PX are normally driven by the adjusting controller 400.

In the embodiment of the present disclosure, in order to shorten operation time of each element causing low cost and high operation speed of the elements, preferably, at step S330 the adjust controller 400 downgrades the resolution of the displaying image to one fourth of original resolution, i.e. a resolution of 720×1280. It is therefore understood that the downgraded ratio disclosed above is an example, rather than a limitation. The downgraded ratio can be selected based on practical requirement.

Specifically, the step S330 further comprises: the frequency raising unit 410 doubles a frame rate of the displaying image. It is understood that a raised multiple of the frame rate is associated with a lowered proportion of the resolution.

The scan driving unit 420 supplies gate signal to pixels PX at odd-numbered rows through gate lines and the data driving unit 430 supplies data signal to pixels PX at odd-numbered columns through data lines in a duration of displaying a frame A.

The scan driving unit 420 supplies gate signal to pixels PX at odd-numbered rows through gate lines and the data driving unit 430 supplies data signal to pixels PX at even-numbered columns through data lines in a duration of displaying a frame A+1.

The scan driving unit 420 supplies gate signal to pixels PX at even-numbered rows through gate lines and the data driving unit 430 supplies data signal to pixels PX at odd-numbered columns through data lines in a duration of displaying a frame A+2.

The scan driving unit 420 supplies gate signal to pixels PX at even-numbered rows through gate lines and the data driving unit 430 supplies data signal to pixels PX at even-numbered columns through data lines in a duration of displaying a frame A+3.

At step S340, when all pixels PX are normally driven by the adjusting controller 400, the scan driving unit 420 supplies gate signal to all of the pixels PX through gate lines and the data driving unit 430 supplies data signal to all of the pixels PX through data lines.

Additionally, the application is described based on the method and device (system) of the embodiments. It is understood that each processes and/or blocks illustrated in the flowchart and/or block diagram or a combination of the processes and/or blocks illustrated in the flowchart and/or block diagram can be implemented by software instructions executable by at least one processor of a machine such as a general computer, special purpose computer, an embedded computer or other programmable processing equipment. The processor of the machine executes the software instructions to perform one or more processes and/or blocks illustrated in the flowchart and/or block diagram.

All the elements or units of the display according to the embodiments of the present disclosure can be realized by hardware circuit. Based on the functions of the elements or units of the display, one skilled in the art can realize all the elements or units of the display by using field-programmable gate array (FPGA) or application specific integrated circuit (ASIC).

To sum up, by using the display and the method of prolonging lifetime of the display according to the present embodiment, the requirement energy of displaying image is greatly reduced, thereby saving cost. In addition, all of the pixels PX are alternately applied to data voltage to display during displaying frames. Accordingly, a lifetime of each of pixels PX are prolonged as well as the display.

Above are embodiments of the present invention, which does not limit the scope of the present invention. Any modifications, equivalent replacements or improvements within the spirit and principles of the embodiment described above should be covered by the protected scope of the invention.

What is claimed is:

1. A display comprising:

a monitor, configured to monitor a display time period of a displaying image;

a determining controller, configured to determine whether the display time period of the display image is not less than a predetermined time period; and a adjusting controller, configured to lower a resolution of the displaying image upon a condition that the display time period of the display image is not less than a predetermined time period, wherein the display comprises M×N pixels arranged in an array, the adjusting controller comprises a frequency raising unit configured to double a frame rate of the displaying image, a scan driving unit configured to supply gate signal to the pixels, and a data driving unit configured to supply data signal; and wherein the scan driving unit supplies gate signal to pixels at odd-numbered rows and the data driving unit supplies data signal to pixels at odd-numbered columns in a duration of displaying a frame A;

the scan driving unit supplies gate signal to the pixels at odd-numbered rows and the data driving unit supplies data signal to pixels at even-numbered columns in a duration of displaying a frame A+1;

the scan driving unit supplies gate signal to pixels at even-numbered rows and the data driving unit supplies data signal to the pixels at odd-numbered columns in a duration of displaying a frame A+2; and the scan driving unit supplies gate signal to the pixels at the even-numbered rows and the data driving unit supplies data signal to pixels at the even-numbered columns in a duration of displaying a frame A+3.

2. The display of claim 1, wherein the adjusting controller is configured to lower the resolution of the displaying image to one fourth of an original resolution of the displaying image.

3. The display of claim 1, further comprising M×N pixels arranged in an array, wherein a gate line at ith row is connected to all of pixels at the ith row, while a data line at jth column is connected to all of the pixels at the jth column, where $1 \leq i \leq M$ and $1 \leq j \leq N$;

wherein the scan driving unit supplies the gate signal to the pixels at the odd-numbered rows through the odd-numbered gate lines and the data driving unit supplies the data signal to the pixels at the odd-numbered columns through the odd-numbered data lines in the duration of displaying a frame A;

the scan driving unit supplies the gate signal to the pixels at the odd-numbered rows through the odd-numbered gate lines and the data driving unit supplies the data signal to the pixels at the even-numbered columns through the even-numbered data lines in the duration of displaying a frame A+1;

the scan driving unit supplies the gate signal to the pixels at the even-numbered rows through the even-numbered gate lines and the data driving unit supplies the data signal to the pixels at the odd-numbered columns through the odd-numbered data lines in the duration of displaying a frame A+2; and the scan driving unit supplies the gate signal to the pixels at the even-numbered rows through the even-numbered gate lines and the data driving unit supplies the data signal to the pixels at the even-numbered columns through the even-numbered data lines in the duration of displaying a frame A+3.

4. The display of claim 1 being an organic electroluminescence display.

5. A method of prolonging a lifetime of a display that comprises M×N pixels arranged in an array, comprising:

monitoring a display time period of a displaying image;

determining whether the display time period of the display image is not less than a predetermined time period; and if the display time period of the display image is not less than the predetermined time period, doubling a frame rate of the display image;

supplying gate signal to pixels at odd-numbered rows and supplying data signal to pixels at odd-numbered columns in a duration of displaying a frame A;

supplying gate signal to the pixels at odd-numbered rows and supplying data signal to pixels at even-numbered columns in a duration of displaying a frame A+1;

supplying gate signal to pixels at even-numbered rows and supplying data signal to the pixels at odd-numbered columns in a duration of displaying a frame A+2; and supplying gate signal to the pixels at the even-numbered rows and supplying data signal to pixels at the even-numbered columns in a duration of displaying a frame A+3.

6. The method of claim 5, wherein a step of lowering a resolution of the displaying image comprises: lowering the resolution of the displaying image to one fourth of an original resolution of the displaying image.

7. The method of claim 5, wherein the display comprises M gate lines and N data lines; a gate line at ith row is connected to all of pixels at the ith row, while a data line at jth column is connected to all of the pixels at the jth column, where $1 \leq i \leq M$ and $1 \leq j \leq N$; the step of lowering a resolution of the displaying image comprises:

supplying the gate signal to the pixels at the odd-numbered rows through the odd-numbered gate lines and supplying the data signal to the pixels at the odd-numbered columns through the odd-numbered data lines in the duration of displaying a frame A;

supplying the gate signal to the pixels at the odd-numbered rows through the odd-numbered gate lines and supplying the data signal to the pixels at the even-numbered columns through the even-numbered data lines in the duration of displaying a frame A+1;

supplying the gate signal to the pixels at the even-numbered rows through the even-numbered gate lines and supplying the data signal to the pixels at the odd-numbered columns through the odd-numbered data lines in the duration of displaying a frame A+2; and supplying the gate signal to the pixels at the even-numbered rows through the even-numbered gate lines and supplying the data signal to the pixels at the even-numbered columns through the even-numbered data lines in the duration of displaying a frame A+3.

8. The method of claim 5, wherein the display is an organic electroluminescence display.

* * * * *